US005253968A

United States Patent [19]

Paedae, Jr.

[11] Patent Number: 5,253,968

[45] Date of Patent: Oct. 19, 1993

[54] PORTABLE BOOK SPINER APPARATUS

[76] Inventor: Dennis C. Paedae, Jr., 5045 Carpenter Creek Dr., Pensacola, Fla. 32503

[21] Appl. No.: 888,155

[22] Filed: May 26, 1992

[51] Int. Cl.[5] ..... B42B 5/06

[52] U.S. Cl. ..... 412/34; 412/6

[58] Field of Search ..... 412/33, 34, 6

[56] References Cited

U.S. PATENT DOCUMENTS

| | | | |
|---|---|---|---|
| 1,274,154 | 7/1918 | Etheridge . | |
| 2,729,835 | 1/1956 | Spinner . | |
| 3,727,256 | 4/1973 | Gill | 412/34 |
| 3,881,203 | 5/1975 | Giulie | 412/34 |
| 4,259,799 | 4/1981 | Fulton, Jr. . | |
| 4,575,123 | 3/1986 | Giblin et al. . | |

FOREIGN PATENT DOCUMENTS

| | | | |
|---|---|---|---|
| 783846 | 4/1968 | Canada | 412/34 |
| 2815912 | 4/1978 | Fed. Rep. of Germany . | |

*Primary Examiner*—Mark Rosenbaum
*Assistant Examiner*—S. Thomas Hughes
*Attorney, Agent, or Firm*—Vorys, Sater, Seymour & Pease

[57] ABSTRACT

A portable book binding apparatus is disclosed which includes a platform mountable on a support surface. The platform includes an elongated channel being sized and shaped to receive an elongated resilient binder clip. Resilient guiding and spreading fingers are mounted adjacent to and protrude into the entrance of the channel so as to spread the end portions of clip legs of the binding clip when the clip is inserted into the channel. A sheaf of papers is slid along the channel, pass the fingers and between the spread apart clip legs for final positioning within the binder clip.

4 Claims, 2 Drawing Sheets

PORTABLE BOOK SPINER APPARATUS

BACKGROUND OF THE INVENTION

The present invention relates generally to a book binding apparatus and, more particularly, to an improved portable book binding apparatus.

It is desirable to bind a plurality of sheets of paper and book covers into a book in a simple and convenient manner. Typically, resilient binder clips are used to secure the marginal edges of the papers and form the spine of the resulting books. The binder clips are made of a flexibly resilient material having spaced apart and generally parallel legs. The legs are normally spaced in close proximity to each other so that they must be deflected outwardly for allowing insertion of a sheaf of papers therebetween. A spring type action provided by the legs retains the sheaf of papers in the manner of a bound book. Typically, it is difficult to insert flexible sheet materials into such a spine and various devices have been proposed to address this problem. One known approach for binding is described in U.S. Pat. No. 2,729,835, wherein a machine or device is used for purposes of allowing the clipping together of one or more sheets of paper. In this approach the device includes a raised platform onto which various sheets of material are placed during the binding process. The platform includes a lip along one edge which is adapted to engage the leading edge of a resilient binder clip. After the sheets of paper have been placed on the platform the binder clip is inserted over the lip and its legs encompass the marginal edges of the sheets after being spread apart by engaging the lip as the binder clip is slid therepast.

Another approach is described in U.S. Pat. No. 3,881,203 which discloses a tool for inserting a sheaf of papers into a plastic binder clip of the type noted in a convenient manner. Use of this has many disadvantages. For instance, the user must grasp it between the fingers and press it firmly between the legs of the binder clip before a sheaf of papers can be inserted in the clip. In practice, this is a rather tedious and cumbersome manual approach.

Still another approach is described in German Patent No. 28 15 912 which relates to a special device and tool that forces a resilient binder clip against a spreading member so that the binder clip can encompass a stationary sheaf of papers.

While several approaches have been put forth there is an ongoing interest in improving such binders.

SUMMARY OF THE INVENTION

In accordance with the present invention there is provided an improved book binding apparatus which includes platform means mountable on a support surface. Included in the platform means is an elongated channel being sized and shaped to generally receive therein an elongated resilient binder clip. Guiding and spreading means are provided adjacent an entrance to the binder clip receiving channel. In an illustrated embodiment. The guiding and spreading means includes at least a pair of guiding fingers which are adapted to protrude longitudinally into the entrance of the receiving channel The fingers are spaced apart by a predetermined distance and are adapted to be inserted between the leading edge of the legs of the binder clip. The channel facilitates the fingers entering and spreading at least the end portions of the clip legs when the clip is inserted into the channel. Aligned with the receiving channel is an entry channel. As a consequence, of this arrangement, a sheaf of paper is merely slid along both channels passed the fingers and between the spread apart binder clip legs. In an illustrated embodiment the platform means includes a ledge that permits easy mounting thereof on a table or other like support surface.

It is an object of the present invention to make provision for an improved book binding apparatus; the provision of an improved book binding apparatus which does not require any moving parts; the provision of a book binding apparatus of the foregoing type which is portable; and the provision of a book binding apparatus which facilitates the insertion and removal of a sheaf of papers into a binding clip. These and other objects and further scopes of applicability of the present invention will become apparent from the detail description to follow when taken in conjunction with the accompanying drawings wherein like parts are designated by like reference numerals throughout the several views.

DETAILED DESCRIPTION

Figure 1:
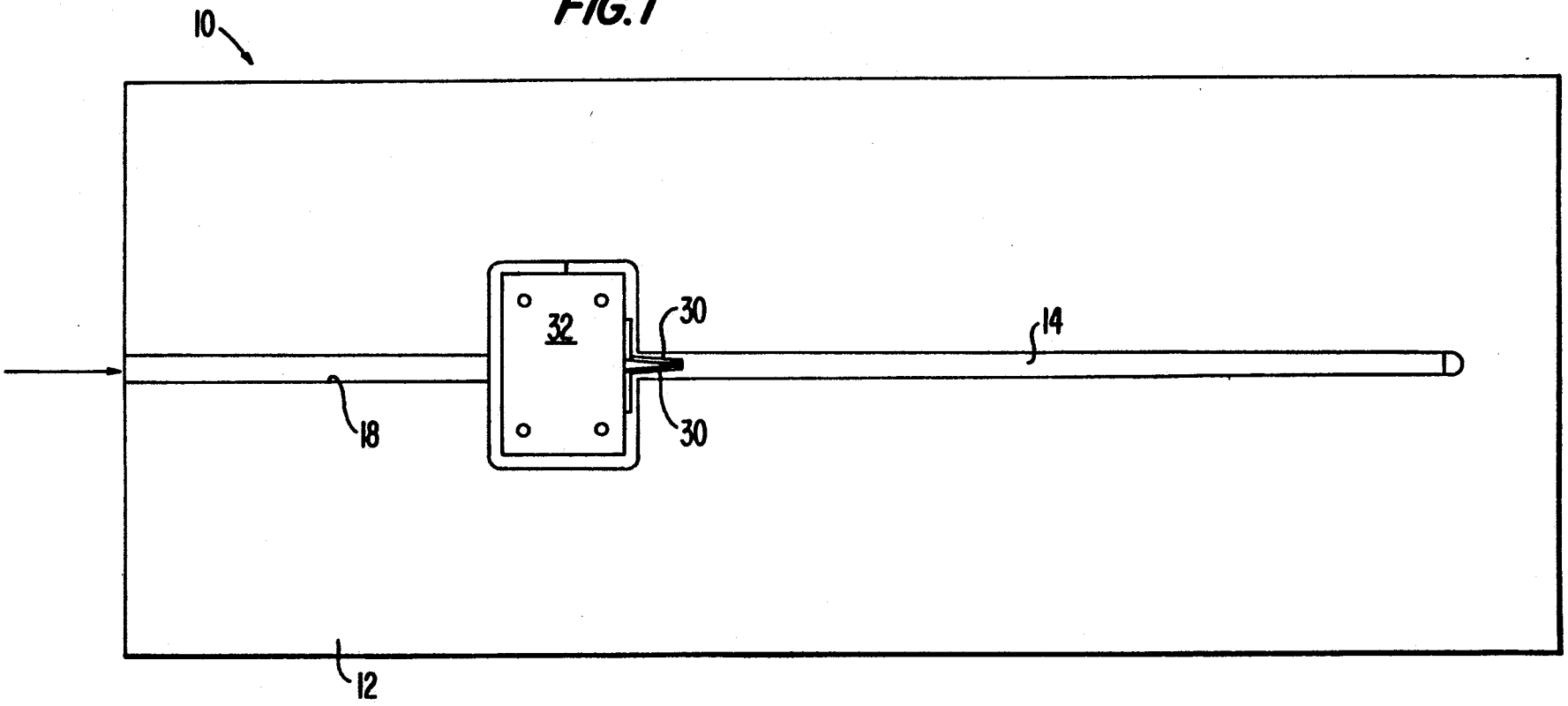
FIG. 1 is a plan view of the book binding apparatus made according to the principles of the present invention.

Reference is made to FIGS. 1-4 for illustrating a preferred embodiment of a book binding apparatus 10 made according to the present invention. The binding apparatus 10 includes a generally planar platform 12 being constructed of a material, such as wood, as well as is sized and dimensioned so that it is easily portable, yet capable of withstanding the use contemplated. An elongated narrow binder clip receiving channel 14 is formed within the platform for receiving a flexible resilient binder clip 16 (FIGS. 2 and 3) in a manner which will be described subsequently. Aligned with the binder clip receiving channel 14 is an entry channel 18 which guides the sheets of a book or the like into the binder clip 16. Also, the platform 12 is formed with a ledge 20 adjacent one end thereof so as to facilitate mounting of the platform 12 on a table or the like.

Figure 2:
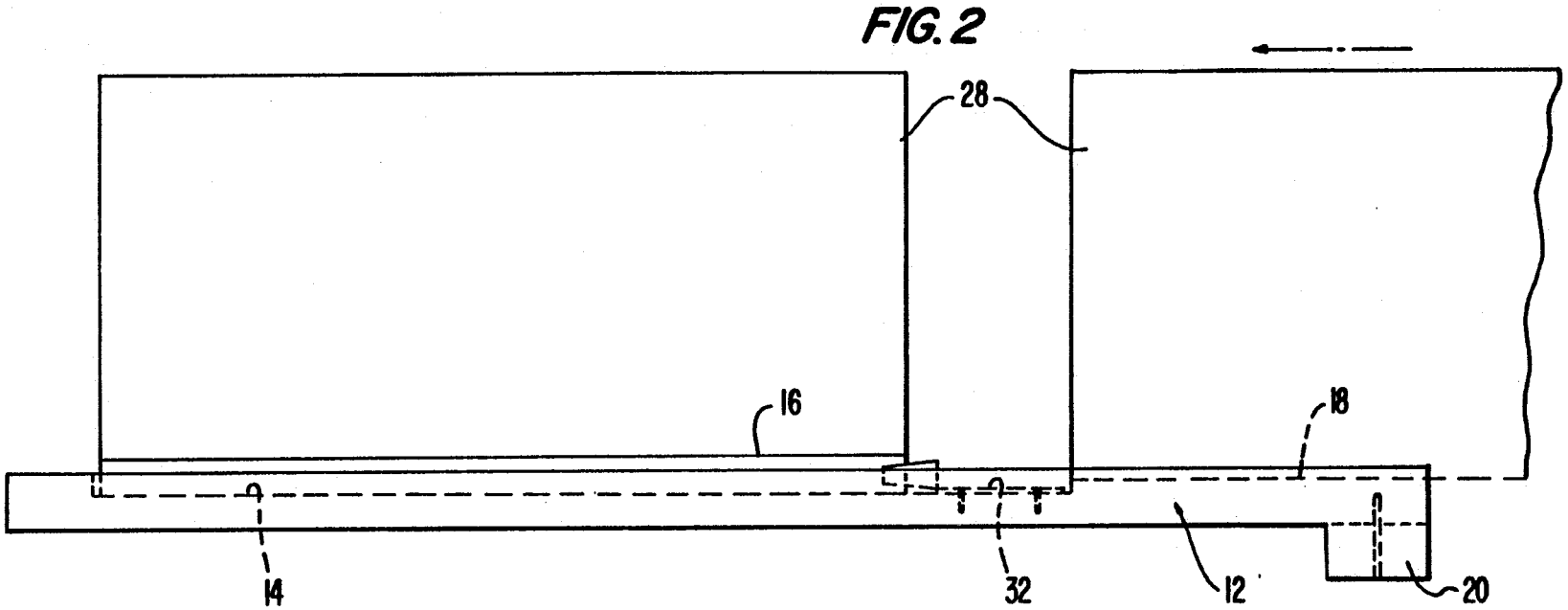
FIG. 2 is a side elevational view of the illustrated embodiment cooperating with a book binding clip and sheet material being inserted therein.
Figure 3:
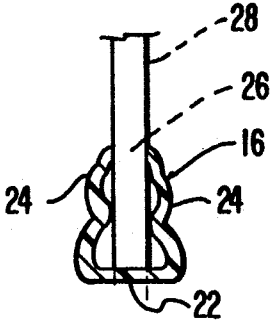
FIG. 3 is a cross-sectional view of a binder clip of the type usable in conjunction with the binding apparatus shown in FIGS. 1 and 2; and, FIG. 4 is an enlarged and fragmented view of the spreading fingers cooperating with the binding clip.

Reference is made to FIGS. 2 and 3 for illustrating the binder clip 16. It is of a conventional type defined by an extruded PVC plastic material body having an elongated back 22 and a pair of parallel and spaced apart legs 24 which define a space or channel 26 therebetween. The legs 24 are flexibly resilient and tend to spring back to their original position following slidable insertion into the channel 26 of an edge of a sheaf of papers 28 assembled together to form a book or the like. The binder clip 16 forms a stiff backing for the sheets of paper 28 so as to constitute the spine of a resulting book. Other types of binder clips are contemplated for use as well.

Figure 4:
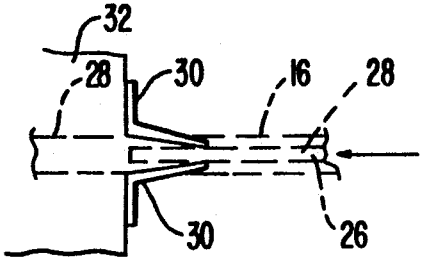

As shown in FIGS. 1 and 4, there is provided a pair of longitudinally extending metallic spreading fingers 30 which extends into the mouth of the receiving channel 14. The distal ends of the fingers 30 converge to a spaced apart relationship which is adapted to be inserted into the channel. The fingers 30 are sufficiently strong so as to deflect the binder clip legs 24 outwardly. As a result, a leading edge of a sheaf of papers 28 can be inserted into the widened clip channel 26 after being guided by the entry channel 18 and the spaced apart fingers themselves. The proximal ends of the fingers are connected to a mounting plate 32 which is mounted in a recess of the platform 12. Although the illustrated embodiment of the present embodiment depicts the fingers 30 connected to the plate 32 for reinforcing purposes it will be appreciated that such a plate is not required. Instead the fingers can be connected to the platform and extend into the channel for engaging and spreading apart retaining arms of the binder clip upon insertion of the latter into the channel 14. The foregoing sliding entry of the sheets of paper into the channel 26. Also the fingers facilitate removal of the bound book including the clip 16.

It is believed that the foregoing description describes the structure and operation of this embodiment. Since certain changes may be made in the above-described apparatus, it is intended that all matter contained in the description and shown in the drawings be interpreted as illustrative and not in a limiting sense.

What is claimed:

1. An improved portable book binding apparatus which comprises:

platform means being portable and mountable on a support surface;

said platform means including an elongated channel being sized and shaped to generally removably receive therein an elongated and resilient sheet material binder clip into which a sheaf of sheet material is insertable;

guiding and spreading means adjacent an entrance to said binder clip receiving channel;

said guiding and spreading means includes at least a pair of elongated and spaced apart, flexibly resilient guiding and spreading fingers which are adapted to protrude longitudinally into said receiving channel;

said guiding and spreading fingers are spaced apart at least by a predetermined distance and are constructed and mounted so as to be inserted between leading end portions of leg portions of the binder clip so as to spread apart the leading end portions, to thereby allow and guide a sheaf of sheet material between said guiding and spreading finders and into and between the leg portions of the binder clip;

said receiving channel facilitates guiding of the binder clip in said channel onto said guiding and spreading fingers so that said guiding and spreading fingers spread apart at least the end portions of the clip leg portions thereby facilitating slidable insertion of a sheaf of papers between the guiding and spreading fingers into and between the binder clip leg portions.

2. The apparatus of claim 1 wherein said platform means is portable and is generally planar in construction, said platform means includes a mounting ledge for mounting against an edge of the support surface which can support said platform means.

3. The apparatus of claim 2 wherein said platform means includes an entry channel which is aligned with said binder clip receiving channel so as to facilitate sliding of sheets of paper between said fingers and into and between the leg portions of the binder clip.

4. An improved book binding apparatus which comprises:

platform means mountable on a support surface;

said platform means including an elongated channel being sized and shaped to generally removably receive therein an elongated and resilient sheet material binder clip into which a sheaf of material is insertable;

guiding and spreading means fixedly mounted adjacent an entrance to said binder clip receiving channel;

said guiding and spreading means includes at least a pair of flexibly resilient guiding and spreading fingers which are adapted to protrude longitudinally into said receiving channel;

said guiding and spreading fingers are spaced apart by at least a predetermined distance and are constructed and mounted so as to be inserted between leading end portions of leg portions of the binder clip so as to spread apart the leading end portions to thereby allow and guide a sheaf of sheet material between said guiding and spreading fingers and into and between the legs of the binder clip;

said receiving channel facilitates guiding the binder in said channel onto said fingers so that said fingers spread apart at least the end portions of the clip leg portions, thereby facilitating slidable insertion of a sheaf of papers between said guiding and spreading fingers into and between the binder clip leg portions.

* * * * *